US006525639B1

(12) United States Patent
Cheng

(10) Patent No.: US 6,525,639 B1
(45) Date of Patent: Feb. 25, 2003

(54) POWER SOURCE ELECTRICAL SWITCH

(76) Inventor: Tsang-I Cheng, 707 Room, No. 293, Sung Chiang Rd., Taipei (TW)

( * ) Notice: Subject to any disclaimer, the term of this patent is extended or adjusted under 35 U.S.C. 154(b) by 30 days.

(21) Appl. No.: 09/928,990

(22) Filed: Aug. 15, 2001

(51) Int. Cl.[7] ..... H01H 37/02; H01H 61/00

(52) U.S. Cl. ..... 337/37; 337/59; 337/112; 337/334; 200/553

(58) Field of Search ..... 337/35–40, 52, 337/59, 112, 113, 333, 334, 298, 380, 398–400; 200/553–557

(56) References Cited

U.S. PATENT DOCUMENTS

| | | | | | |
|---|---|---|---|---|---|
| 4,510,479 | A | * | 4/1985 | Merchant | 337/91 |
| 5,451,729 | A | * | 9/1995 | Onderka et al. | 200/18 |
| 5,541,569 | A | * | 7/1996 | Jang | 337/68 |
| 6,121,868 | A | * | 9/2000 | Chiang | 337/37 |
| 6,154,116 | A | * | 11/2000 | Sorenson | 337/37 |
| 6,275,134 | B1 | * | 8/2001 | Chen | 337/37 |

* cited by examiner

*Primary Examiner*—Jayprakash N. Gandhi
(74) *Attorney, Agent, or Firm*—Browdy and Neimark, P.L.L.C.

(57) ABSTRACT

An electrical switch comprises a housing in which at least two power source terminals and a conductive piece are disposed such that the conductive piece is fastened at one end with one of the two power source terminals for electrically conducting or interrupting the two power source terminals. The conductive piece is connected with a link structure by which an external force causes the conductive piece to make contact with or separate from other one of the two power source terminals. A spring piece is fastened at one end with the housing and at other end with the link structure. The spring piece enables the conductive piece to jump so as to separate from other one of the two power source terminals at the time when the conductive piece is overheated. The electrical switch further comprises an adjustment device for providing with a predetermined force against the conductive piece under the circumstance that the conductive piece is electrically connected with the power source terminals such that the critical overheated temperature of the conductive piece can be set.

6 Claims, 4 Drawing Sheets

POWER SOURCE ELECTRICAL SWITCH

FIELD OF THE INVENTION

The present invention relates generally to a power source switch, and more particularly to an electrical switch.

BACKGROUND OF THE INVENTION

As shown in FIG. 1, an electrical switch 1 of the prior art comprises a case 2, two power source terminals 3*a* and 3*b* which are disposed in the case 2, a conductive piece 4, a touch switch structure 5, and a spring piece 6. The conductive piece 4 is fastened at one end with the power source terminal 3*a*. The touch switch structure 5 has a push button 5*a* and an action rod 5*b* disposed under the push button 5*a*. The push button 5*a* is disposed over the case 2. The action rod 5*b* is connected at the free end with other end of the conductive piece 4. The spring piece 6 is connected with other end of the conductive piece 4 such that the spring piece 6 urges the action rod 5*b*. In operation, the push button 5*a* is first pressed to cause two ends of the conductive piece 4 to make contact with the two power source terminals 3*a* and 3*b*, thereby resulting in the current flow. When the conductive piece 4 is overloaded, the conductive piece 4 is caused to deform by heat. As a result, the spring piece 6 is forced to jump upwards, so as to push the action rod 5*b* to displace upwards. The conductive piece 4 and the spring piece 6 are actuated to move upwards to bring about the separation of the conductive piece 4 from the power source terminal 3*b*, thereby resulting in interruption of the flow of the electric current. In light of the spring piece 6 urging only one side of the action rod 5*b*, the action rod 5*b* is apt to move aside. In addition, the extent of deformation of the conductive piece 4 is often dependent on the climatic factors as well as the nature of the material of which the conductive piece 4 is made. In other words, the conductive piece 4 and the spring force 6 of the prior art electrical switch are not reliable at best. The prior art electrical switch is thus a potential fire hazard.

SUMMARY OF THE INVENTION

The primary objective of the present invention is to provide an electrical switch which is capable of a precision interruption of the flow of an electrical current.

The electrical switch of the present invention comprises a housing in which at least two power source terminals are fixedly disposed such that one of the two terminals is connected with a conductive piece which is disposed in the housing for conducting or interrupting electrically the two terminals. A link structure comprises a push button which is pivoted in the housing, and a support rod fastened at one end with the push button. The support rod is connected at other end with the conductive piece such that an external force enables the support rod to cause the conductive piece to make contact with or to separate from other one of the two power source terminals. A spring piece is fastened with the housing and the support rod of the link structure. When the current of the conductive piece is excessive, the spring piece is so heated as to jump to cause the conductive piece to separate from other one of the two terminals. An adjustment device is exerted on by a predetermined force to change the condition of being heated by the conductive piece under the circumstance that the conductive piece is electrically connected with the two power source terminals.

DETAILED DESCRIPTION OF THE INVENTION

Figure 1:
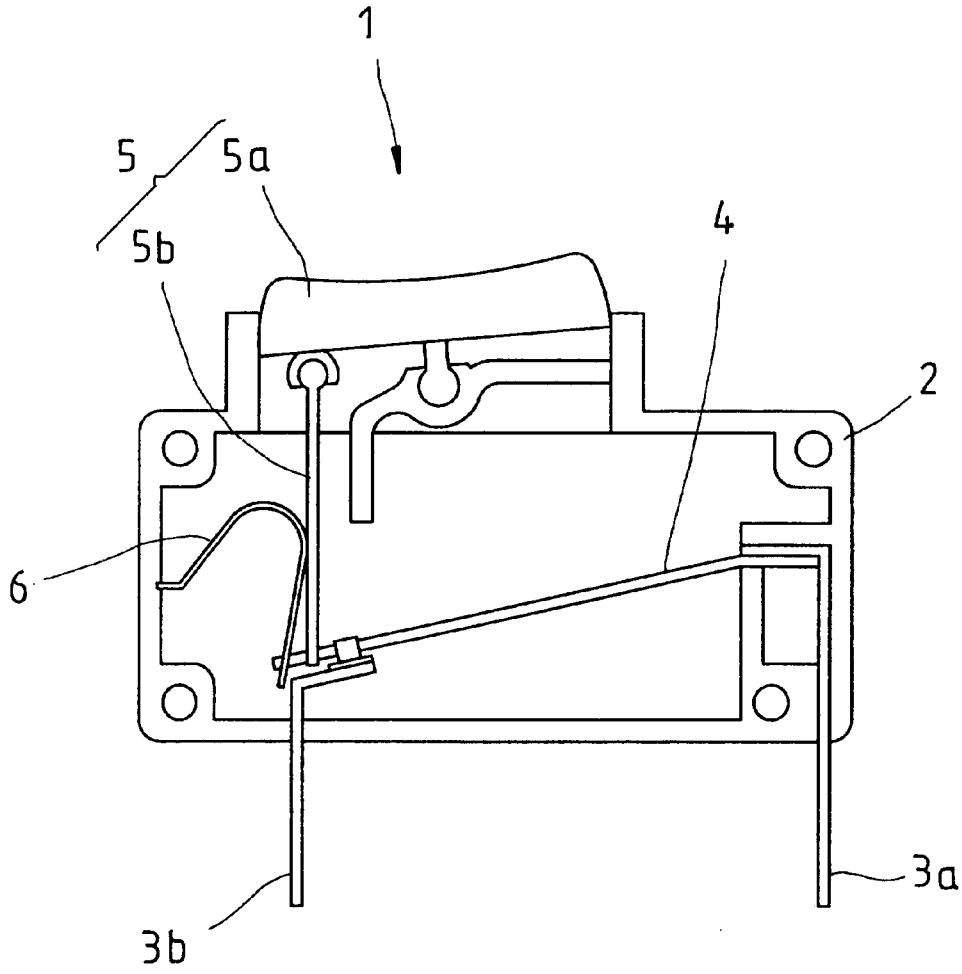
FIG.1 PRIOR ART
FIG. 1 shows a sectional view of an electrical switch of the prior art.
Figure 2:
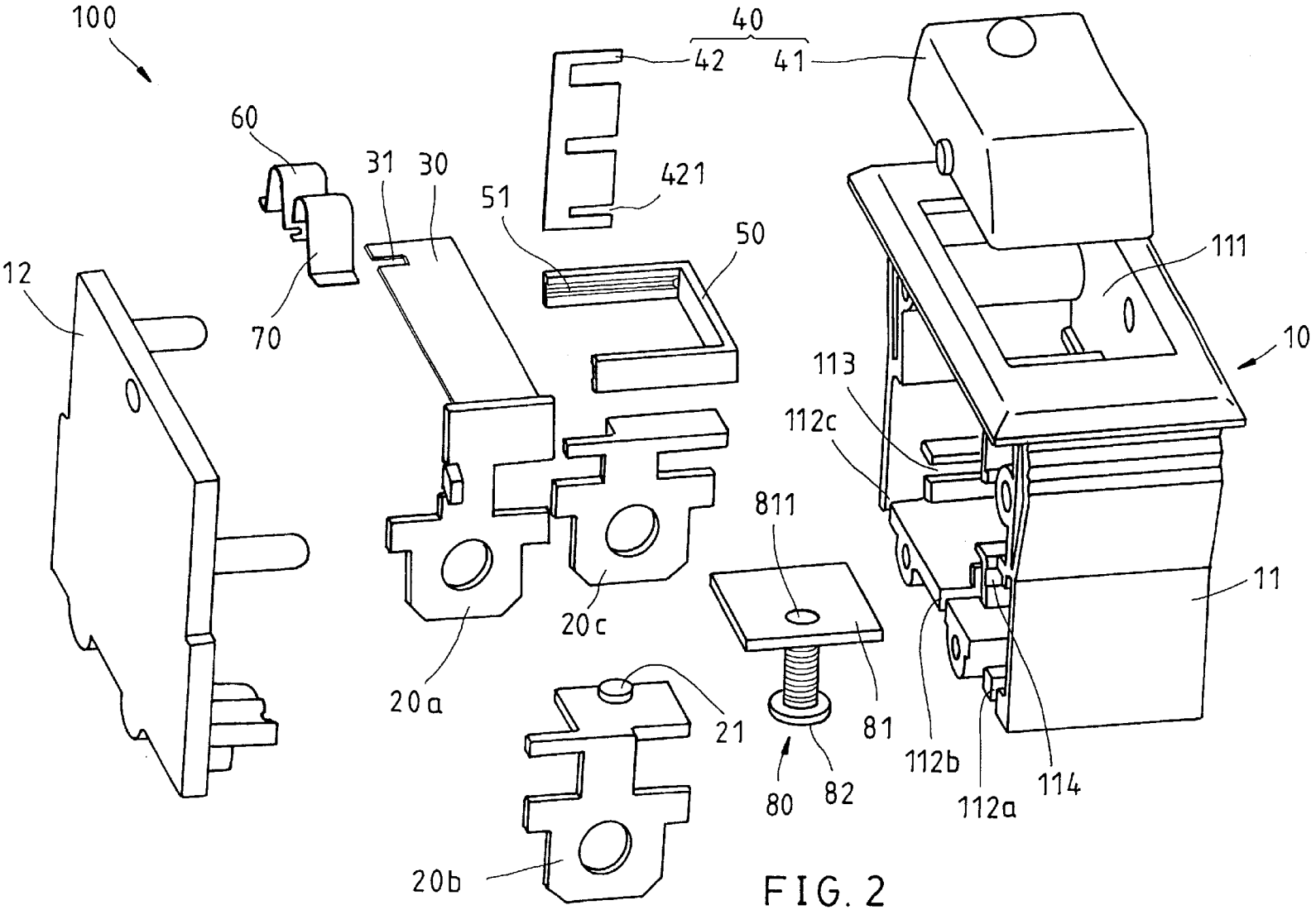
FIG. 2 shows an exploded view of a preferred embodiment of the present invention.
Figure 3:
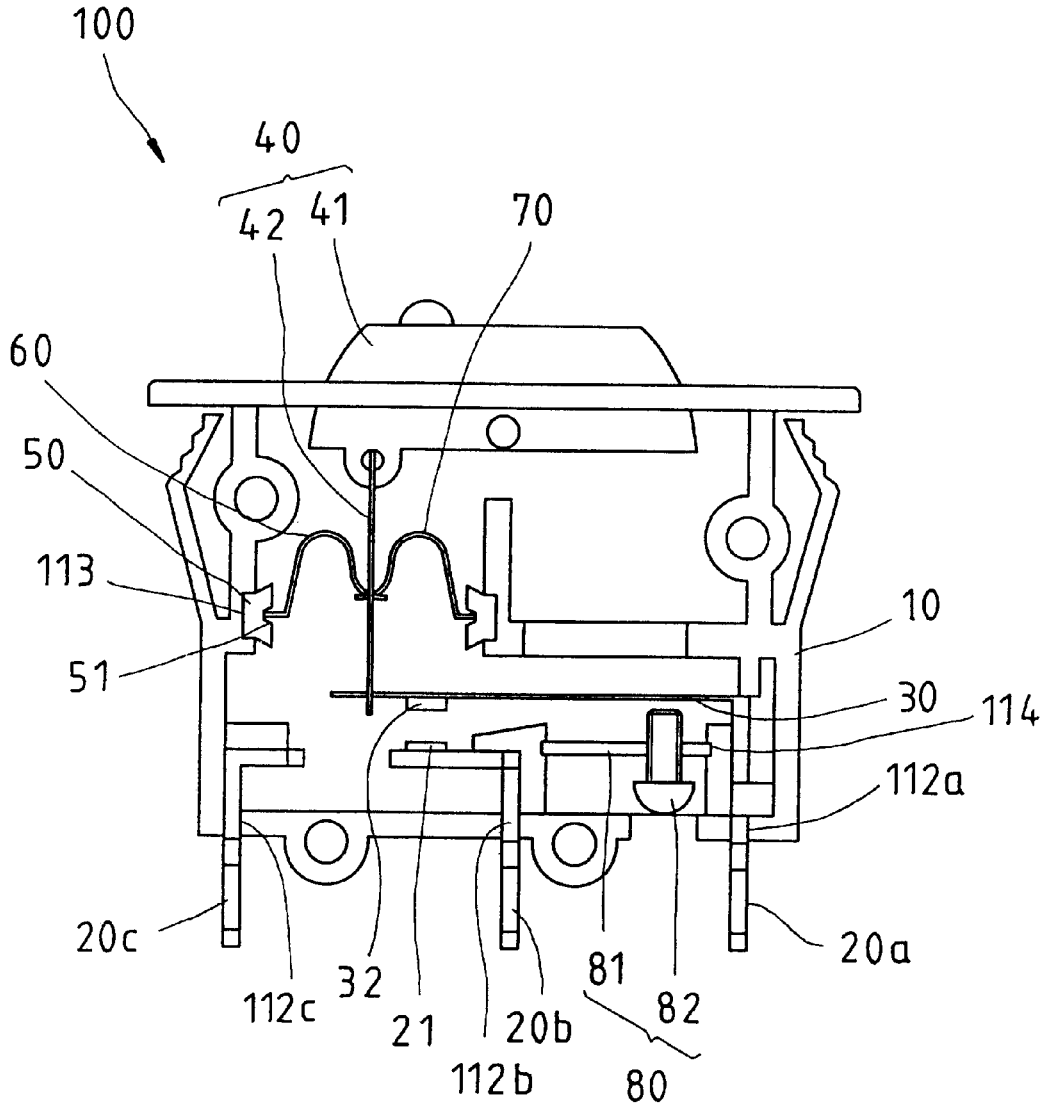
FIG. 3 shows a schematic view of the preferred embodiment of the present invention in combination and without the adjustment device, with the cover thereof being removed.
Figure 4:
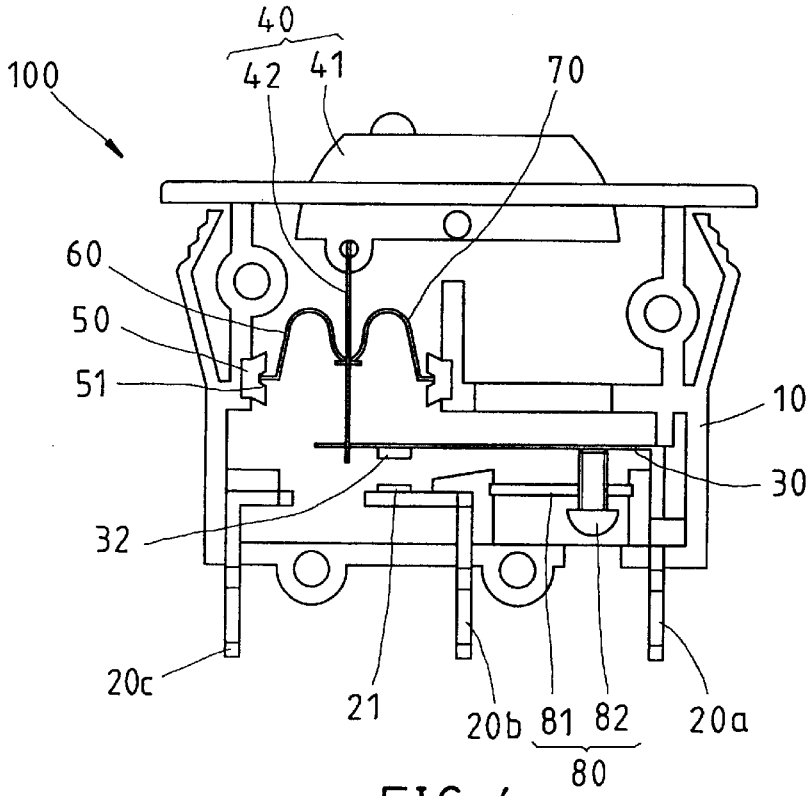
FIG. 4 shows a schematic view of the preferred embodiment of the present invention in combination and with the adjustment device in the state of current interruption, with the cover thereof being removed.

As shown in FIGS. 2–4, an electrical switch 100 of the preferred embodiment of the present invention comprises a housing 10, three power source terminals 20*a*, 20*b* and 20*c*, a conductive piece 30, a link structure 40, a carrying seat 50, a spring piece 60, an auxiliary spring piece 70, and an adjustment device 80.

The housing 10 is made of a fireproof insulating material and is formed of a main housing 11 and a cover 12. The main housing 11 is provided in the top with a receiving slot 111 which is provided in the interior with a plurality of recesses 112*a*, 112*b*, 112*c*, 113, 114, with each having a predetermined pattern. The cover 12 is joined with the main housing 11 to form a receiving chamber with the receiving slot 111 serving as an opening of the receiving chamber.

The power source terminals 20*a*, 20*b*, 20*c* are made of a metal material conductive to electrical energy and are connected with an external power source. These three terminals are respectively disposed in the recesses 112*a*, 112*b*, 112*c*. The power source terminal 20*b* is provided in the top with a protruded connection portion 21. The power source terminal 20*c* serves as an auxiliary terminal without a conducting function. The auxiliary terminal serves as an insertion means.

The conductive piece 30 is made of a thermocouple material of metal, alloy or superalloy and conductive to electrical current. The conductive piece 30 is capable of tolerating a predetermined heat when the conductive piece 30 is in a stable state. The conductive piece 30 is disposed in the housing 10 such that one end of the conductive piece 30 is fastened with the power source terminal 20*a*, and that other end of the conductive piece 30 is provided with a first insertion slot 31 and a contact portion 32, as shown in FIG. 3.

The link structure 40 comprises a push button 41 and a support rod 42. The push button 41 is made of a fireproof insulation material, such as AS. The push button 41 is pivoted in the receiving slot 111 of the top of the housing 10 such that a portion of the push button 41 is jutted out of the housing 10, and that the push button 41 is capable of switching between an open position and a close position. The support rod 42 is disposed in the housing 10 such that one end of the support rod 42 is fastened with the underside of one side of the push button 41, and that other end of the support rod 42 is provided with a second insertion slot 421 which is intended to engage the first insertion slot 31 of the conductive piece 30, thereby bringing about the linking action between the push button 41 and the conductive piece 30. In the linking process, the contact portion 32 of the conductive piece 30 makes contact with or separates from the connection portion 21 of the power source terminal 20*b*.

The carrying seat 50 is fixedly disposed in the recess 113 of the housing 10 and is provided with a retaining slot 51.

The spring piece 60 is made of a material conductive to heat energy. Two ends of the spring piece 60 are respectively disposed in the retaining slot 51 of the carrying seat 50 and the second insertion slot 421 of the support rod 42 of the link structure 40. The spring piece 60 has a spring force which exerts on one side of the support rod 42.

The auxiliary spring piece 70 has one end, which is disposed in the retaining slot 51 of the carrying seat 50, and other end which is disposed in the second insertion slot 421 of the support rod 42 of the link structure 40. The auxiliary spring piece 70 is connected with the spring piece 60 such that the auxiliary spring piece 70 and the spring piece 60 are located at the support rod 42 to be in a symmetrical position. The spring force of the auxiliary spring piece 70 exerts on other side of the support rod 42. As a result, the support rod 42 is simultaneously acted on by the spring forces of the spring piece 60 and the auxiliary spring piece 70. The support rod 42 works with precision.

Figure 5:
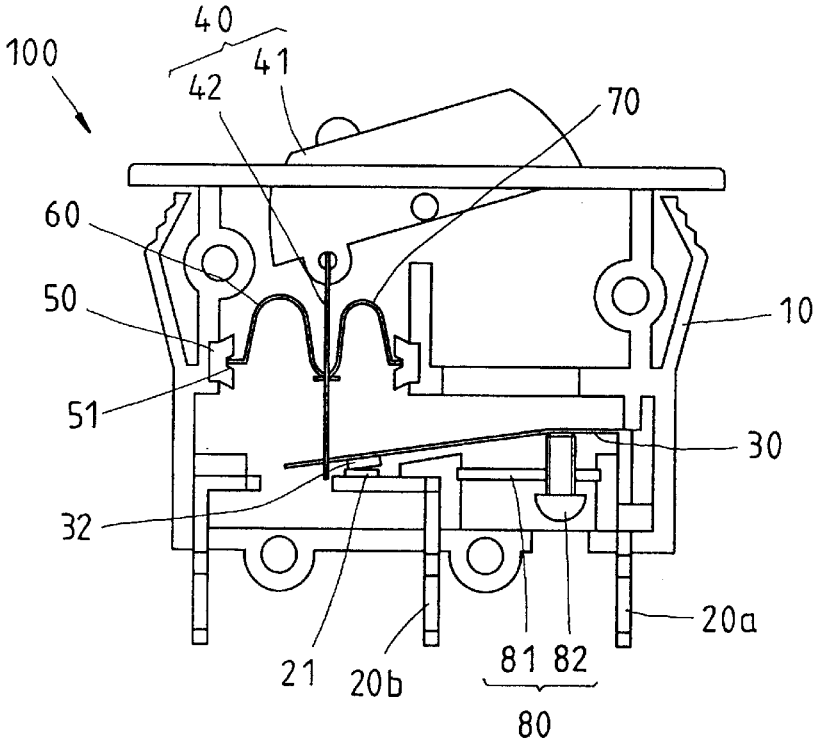
FIG. 5 shows a schematic view of the preferred embodiment of the present invention in combination and with the adjustment device in the conductive state, with the cover thereof being removed.

The adjustment device 80 is used to adjust and change the magnitude of force exerting on the conductive piece 30 which is in the state of conducting electrical current. The adjustment device 80 comprises a fixation member 81 and a press member 82. The fixation member 81 is disposed in the housing 10. The press member 82 is joined with the fixation member 81 such that the press member 82 is capable of pressing against the conductive piece 30, thereby adjusting the force which exerts on the conductive piece 30. In the preferred embodiment of the present invention, the fixation member 81 is disposed in the recess 114 of the housing 10 and is provided with a threaded hole 811 in which the press member 82 is disposed such that the press member 82 can be caused by an external force to displace along the threaded hole 811 in relation to the fixation member 81. As shown in FIG. 5, the conductive piece 30 is deformed downwards to become connected with the power source terminal 20*b*. The conductive piece 30 can be exerted on by an upward force to cause the conductive piece 30 to be heated to remain in the power interruption state. The amount of heat that the conductive piece 30 is heated to remain in the power interruption state is inversely proportional to the force of the press member 82 exerting on the conductive piece 30.

As shown in FIGS. 4 and 5, when the push button 41 of the link structure 40 is exerted on by an external force, the push button 41 is turned on such that the push button 41 actuates the support rod 42 to displace downwards, thereby enabling the contact portion 32 of the conductive piece 30 to make contact with the connection portion 21 of the power source terminal 20*b*. In light of the conduction of the conductive piece 30, the power source terminals 20*a* and 20*b* form a current loop, as shown in FIG. 4. In the meantime, the press member 82 of the adjustment device 80 comes in contact with the conductive piece 30 such that a force of a predetermined magnitude is exerted on the conductive piece 30, as shown in FIG. 5. The amount of heat working on the conductive piece 30 can be thus adjusted and changed. In the event that the conductive piece 30 is loaded with an excessive current exceeding a preset heating condition, the conductive piece 30 is subject to deform to force the spring piece 60 and the auxiliary spring piece 70 to jump to cause the support rod 42 to displace upwards. As a result, the push button 41 is swiveled to the OFF position. The conductive piece 30 is actuated by the support rod 42 to separate from the power source terminal 20*b*, thereby resulting in the loss of medium between the two power source terminals 20*a* and 20*b*. The current interruption is thus brought about, as shown in FIG. 4.

The present invention apparently has advantages over the prior art electrical switches. The advantages of the present invention are described hereinafter.

In light of the support rod 42 being pressed against from two opposite sides by the spring forces of the spring piece 60 and the auxiliary spring piece 70, the support rod 42 is evenly exerted on by the forces such that the support rod 42 is securely located to prevent from moving aside. As a result, the conductive piece 30 is able to work with precision.

The electrical switch 100 of the present invention is provided with the adjustment device 80 which is used to exert a pressure on the conductive piece 30 in the conducting state, thereby enabling the conductive piece 30 to recuperate to be heated. As a result, the heat energy that can be tolerated by the conductive piece 30 can be adjusted. If the adjustment is done strictly such that the conductive piece 30 is pressed against intimately by the press member 82, the conductive piece 30 is caused by heat to deform sooner, so as to enhance the safety insurance of the electrical switch 100 of the present invention.

The spring piece 60 and the auxiliary spring piece 70 of the present invention are first retained on the carrying seat 50, which is then mounted on the housing 10. As a result, the spring piece 60 and the auxiliary spring 70 of the present invention are held securely in place. The spring piece of the prior art electrical switch is retained directly on the housing and is therefore apt to separate from the housing.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following claims.

What is claimed is:

1. An electrical switch comprising:

a housing;

at least two power source terminals disposed in said housing;

a conductive piece disposed in said housing such that one end of said conductive piece is fastened with one of said power source terminals for electrically conducting or interrupting said two power source terminals;

a link structure comprising a push button pivoted in said housing, and a support rod fastened at one end with said push button and at other end with said conductive piece, thereby enabling said conductive piece to be caused by an external force to make contact with or separate from other one of said two power source terminals;

a spring force fastened respectively at two ends with said housing and said support rod of said link structure for enabling said conductive piece to separate from other one power source terminal at the time when said conductive piece is heated excessively;

an adjustment device for providing with a predetermined force against the conductive piece under the circumstance that the conductive piece is electrically connected with the two power source terminals.

2. The electrical switch as defined in claim 1, wherein said adjustment device comprises a fixation member and a press member capable of displacement in relation to said fixation member, so as to exert a predetermined force on said conductive piece.

3. The electrical switch as defined in claim 2, wherein said fixation member is disposed in said housing and is provided with a threaded hole; wherein said press member is disposed in said threaded hole such that said press member is pushed by an external force to displace along said threaded hole in relation to said fixation member, so as to exert a predetermined force on said conductive piece.

4. The electrical switch as defined in claim 1, wherein said conductive piece is made of a thermocouple material.

5. The electrical switch as defined in claim 1 further comprising an auxiliary spring piece which is connected at two ends with said housing and said support rod of said link structure and is symmetrical in location with said spring piece, thereby enabling said support rod to be exerted on evenly by the spring forces of said spring piece and said auxiliary spring piece.

6. The electrical switch as defined in claim 5, further comprising a carrying seat which is fixed in said housing and is provided with a retaining slot for retaining one end of said spring piece and one end of said auxiliary spring piece, thereby enhancing the relative positions of said spring piece and said auxiliary piece.

* * * * *